US009358812B2

(12) United States Patent
Serizawa

(10) Patent No.: US 9,358,812 B2
(45) **Date of Patent: *Jun. 7, 2016**

(54) PRINTING APPARATUS FOR DETECTING AND AVOIDING UNPRINTABLE REGIONS ON RECORDING MEDIUMS

(71) Applicant: CANON KABUSHIKI KAISHA, Tokyo (JP)

(72) Inventor: Kouichi Serizawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

This patent is subject to a terminal disclaimer.

(21) Appl. No.: 13/749,379

(22) Filed: Jan. 24, 2013

(65) Prior Publication Data

US 2013/0135377 A1 May 30, 2013

Related U.S. Application Data

(63) Continuation of application No. 12/957,307, filed on Nov. 30, 2010, now Pat. No. 8,382,227.

(30) Foreign Application Priority Data

Jun. 16, 2010 (JP) ..... 2010-137476

(51) Int. Cl.
*B41J 29/38* (2006.01)
*B41J 11/00* (2006.01)
*B41J 15/00* (2006.01)

(52) U.S. Cl.
CPC ..... *B41J 11/008* (2013.01); *B41J 11/0095* (2013.01); *B41J 15/00* (2013.01)

(58) Field of Classification Search
CPC ..... B41J 11/008; B41J 3/60; B41J 11/0095; B41J 29/293; B41J 11/00; B41J 15/00
USPC ..... 347/14, 16, 19; 101/484; 355/40; 399/19
See application file for complete search history.

(56) References Cited

U.S. PATENT DOCUMENTS

| | | | | |
|---|---|---|---|---|
| 8,382,227 | B2 * | 2/2013 | Serizawa | 347/14 |
| 2002/0139273 | A1 * | 10/2002 | Murata et al. | 101/484 |
| 2003/0026619 | A1 * | 2/2003 | Miyoshi et al. | 399/19 |
| 2004/0100622 | A1 * | 5/2004 | Kaltenbach et al. | 355/40 |
| 2008/0240753 | A1 * | 10/2008 | Kobayashi | B41J 11/008 347/5 |
| 2010/0079529 | A1 * | 4/2010 | Ito et al. | 347/16 |

FOREIGN PATENT DOCUMENTS

| | | | |
|---|---|---|---|
| JP | 2001239715 | * | 9/2001 |
| JP | 2002-046260 | A | 2/2002 |
| JP | 2004-168047 | A | 6/2004 |
| JP | 2009-255383 | A | 11/2009 |

* cited by examiner

*Primary Examiner* — Julian Huffman
(74) *Attorney, Agent, or Firm* — Canon U.S.A., Inc. IP Division

(57) ABSTRACT

A printing apparatus for performing printing on a recording medium includes a printing unit configured to perform printing a plurality of images sequentially on a recording medium, a detection unit configured to detect an unsuitable area that is not suitable for printing on the recording medium, and a control unit configured to control, when the detection unit detects the unsuitable area, so as to define an unprintable region, including the unsuitable area, where the image is not to be printed on the recording medium based on a length of the unsuitable area in a direction of conveyance of the recording medium, and to continue printing the images while avoiding the set unprintable region.

17 Claims, 7 Drawing Sheets

FIG.4A

[JOB MANAGEMENT TABLE]

| JOB-TYPE | MODE | STORAGE DESTINATION ADDRESS |
|---|---|---|
| Idle | 0x0 | — |
| Preliminary Discharge | 0x1 | addr_0 |
| Image | 0x2 | addr_1 |
| Blank-Margin 1 | 0x3 | addr_2 |
| Blank-Margin 2 (Type 1 for Unprintable Part) | 0x4 | addr_3 |
| Blank-Margin 3 (Type 2 for Unprintable Part) | 0x5 | addr_4 |
| Blank-Margin 4 (Type 3 for Unprintable Part) | 0x6 | addr_5 |
| Adjustment Pattern 1 | 0x7 | addr_6 |
| Adjustment Pattern 2 | 0x8 | addr_7 |
| Cut Mark | 0x9 | addr_8 |

FIG.4B

[PRINT JOB TABLE]

| | QUEUE NO. | MODE | THE NUMBER OF LINES |
|---|---|---|---|
| Blank-Margin 1 | 0 | 0x3 | 0x2 |
| Preliminary Discharge | 1 | 0x1 | 0x1 |
| Blank-Margin 1 | 2 | 0x3 | 0x2 |
| Cut Mark | 3 | 0x6 | 0x1 |
| Image | 4 | 0x2 | 0x6 |
| Blank-Margin 1 | 5 | 0x3 | 0x2 |
| Cut Mark | 6 | 0x6 | 0x1 |
| Image | 7 | 0x2 | 0x8 |
| Blank-Margin 1 | 8 | 0x3 | 0x2 |
| Cut Mark | 9 | 0x6 | 0x1 |
| | ↓ | ↓ | ↓ |
| | ↓ | ↓ | ↓ |
| | ↓ | ↓ | ↓ |
| | ↓ | ↓ | ↓ |
| End Command | end | end | end |

EXECUTION SEQUENCE ↓

FIG.4C

[UNPRINTABLE PART SKIP TABLE]

| | INSERTION POSITION QUEUE NO. | MODE | THE NUMBER OF LINES |
|---|---|---|---|
| Blank-Margin 2 | 7 | 0x4 | 0x8 |
| Blank-Margin 1 | | 0x3 | 0x2 |
| Cut Mark | | 0x6 | 0x1 |
| Preliminary Discharge | | 0x1 | 0x1 |

EXECUTION SEQUENCE ↓

PRINTING APPARATUS FOR DETECTING AND AVOIDING UNPRINTABLE REGIONS ON RECORDING MEDIUMS

CROSS REFERENCE OF RELATED APPLICATIONS

This application is a Continuation of U.S. patent application Ser. No. 12/957,307 filed on Nov. 30, 2010 which claims the benefit of Japanese Application No. 2010-137476 filed Jun. 16, 2010, which is hereby incorporated by reference herein in its entirety.

FIELD OF THE INVENTION

The present invention relates to a printing apparatus that performs printing on a recording medium, and to control of a print job.

BACKGROUND OF THE INVENTION

Description of the Related Art

Printing apparatuses, such as an inkjet printer, can perform continuous printing by accepting reservation of a print job before starting printing based on the print job or during printing. The printing apparatuses can reduce a time between print jobs by reserving print jobs, perform continuous printing, and reduce a continuous printing time. Japanese Patent Application Laid-Open No. 2005-085022 discusses a method for changing, when there is a print job agreeing with a reserved print job in size and type of paper (recording medium), an order of executing print jobs to successively execute the reserved print job and the print job agreeing with the reserved print job so that the number of times of occurrence of unnecessary temporary suspension of a printing operation due to differences in size and type of paper among print jobs can be reduced.

However, there is a problem that even if an unprintable part, such as a connecting tape, a smudge, a flaw or a crease, exists on a recording medium when continuous printing is controlled by reserving a print job, printing may be performed by regarding such a part as a printing part.

SUMMARY OF THE INVENTION

According to an aspect of the present invention, a printing apparatus for performing printing on a recording medium includes a printing unit configured to perform printing a plurality of images sequentially on a recording medium, a detection unit configured to detect an unsuitable area that is not suitable for printing on the recording medium, and a control unit configured to control, when the detection unit detects the unsuitable area, so as to define an unprintable region, including the unsuitable area, where the image is not to be printed on the recording medium based on a length of the unsuitable area in a direction of conveyance of the recording medium, and to continue printing the images while avoiding the set unprintable region.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 4A through 4C illustrate job tables according to the exemplary embodiment of the present invention.

DESCRIPTION OF THE EMBODIMENTS

Various exemplary embodiments, features, and aspects of the invention will be described in detail below with reference to the drawings.

Hereinafter, an exemplary embodiment of a printer using an inkjet method is described. The present embodiment is a high-speed printer that uses a continuous sheet wound like a roll and that is compatible with both of one-sided printing and two-sided printing.

Figure 1:
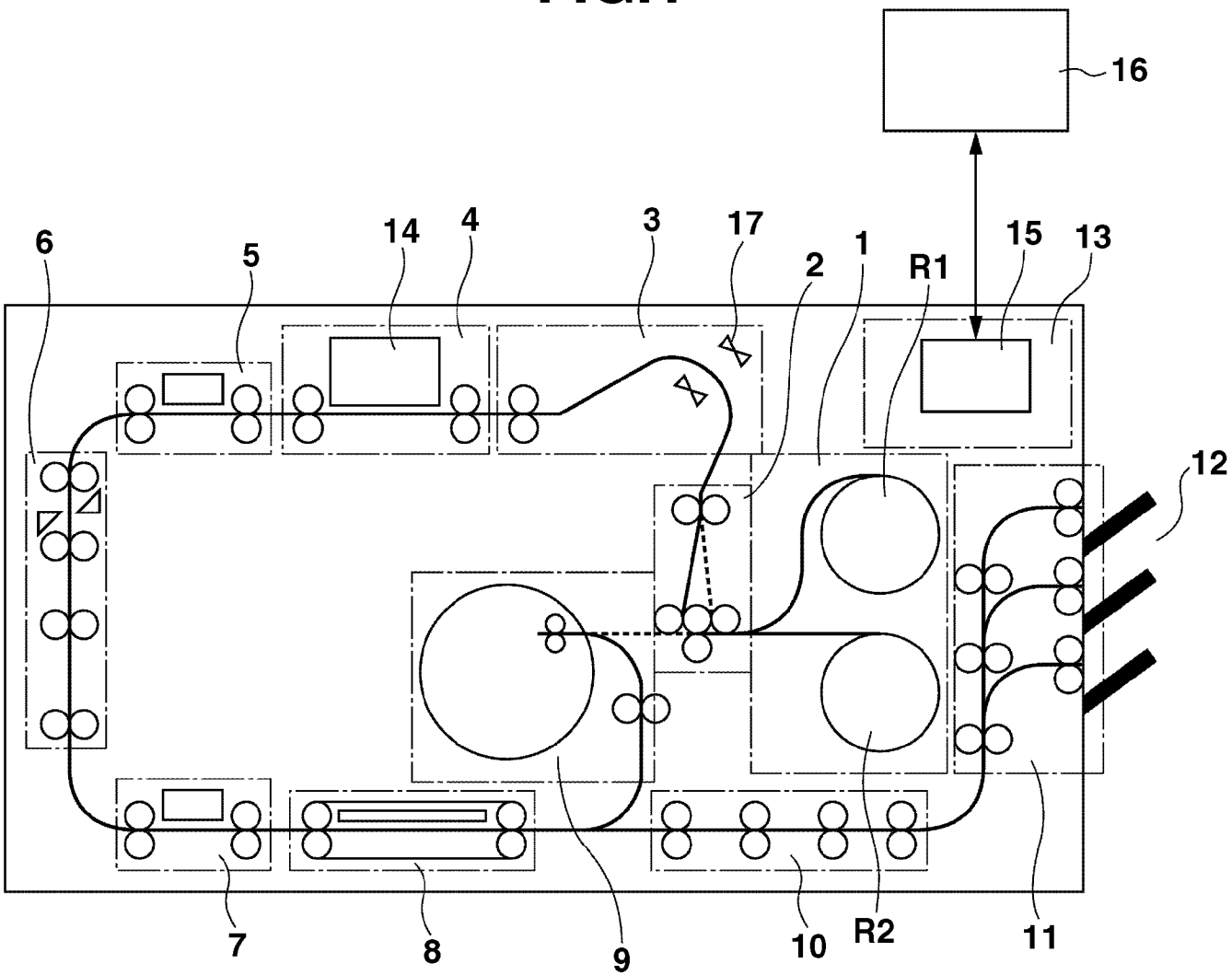
FIG. 1 is a schematic view illustrating an internal configuration of a printer according to an exemplary embodiment of the present invention.

FIG. 1 is a cross-sectional schematic view illustrating an internal configuration of the printer. The internal configuration of the printer roughly includes a sheet supply unit 1, a decurling unit 2, a skew correcting unit 3, a printing unit 4, an inspecting unit 5, a cutter unit 6, an information recording unit 7, a drying unit 8, a sheet take-up unit (sheet reverse unit) 9, a discharging/conveying unit 10, a sorter unit 11, a discharging tray 12, and a control unit 13. A sheet is conveyed, along a sheet conveyance path indicated by solid lines in FIG. 1, by a conveying mechanism configured by roller pairs and belts. During that, the sheet is processed by each of the above units.

The sheet supply unit 1 accommodates and supplies a continuous sheet wound like a roll. The sheet supply unit 1 is configured to accommodate two rolls R1 and R2, and to alternatively select one of the rolls and supply a sheet by drawing the sheet from the selected roll. The number of rolls that can be accommodated in the sheet supply unit 1 is not limited to two. The sheet supply unit 1 can be configured to accommodate either only one or three or more rolls. The decurling unit 2 alleviates a curl (warpage) of a sheet supplied from the sheet supply unit 1 by curving the sheet opposite and squeezing the sheet using two pinch rollers corresponding to one drive roller to put an opposite curl in the sheet. The skew correcting unit 3 corrects a skew (i.e., an inclination with respect to the direction of original movement) of the sheet passed through the decurling unit 2. The skew of the sheet is corrected by pushing a reference-side end portion of the sheet against a guide member.

The printing unit 4 forms an image on a conveyed sheet with a print head 14. The printing unit 4 also has a plurality of conveyance rollers for conveying a sheet. The print head 14 includes a line type print head provided with a printing element array in which a plurality of recording elements are arranged in a range covering a maximum width of a sheet assumed to be used. Ink is discharged from each print head 14 by driving the recording elements at a frequency corresponding to a sheet conveying speed. The control unit 13 which will be described below performs controlling so that a sheet is conveyed at a predetermined speed in a printing operation. The print head 14 is such that a plurality of print heads are arranged in parallel with one another along a conveyance direction. According to the present embodiment, the print head 14 includes seven print heads respectively corresponding to seven colors, i.e., cyan (C), magenta (M), yellow (Y), light cyan (LC), light magenta (LM), gray (G), and black (K). The number of colors and the number of print heads are not limited to seven. A method using heating elements, a method using piezoelectric elements, a method using electrostatic elements, a method using micro-electro-mechanical system (MEMS) elements, and the like can be used as an inkjet method. Ink of each color is supplied to the print head 14 via an associated ink tube from an ink tank.

The inspecting unit 5 optically reads an inspecting pattern and an image printed on a sheet by the printing unit 4 and inspects states of nozzles of the print heads, a sheet conveyance state, image positions, and the like. The inspecting unit 5 detects printed cut marks. The cutter unit 6 has a mechanical cutter for cutting a printed sheet to a predetermined length. When detecting a cut mark, the cutter unit 6 cuts a region corresponding to the detected cut mark. The cutter unit 6 also has a plurality of conveyance rollers for feeding a sheet to the next process. The information recording unit 7 records, on a back surface of the cut sheet, print information such as a serial number and a date of print. The drying unit 8 dries given ink in a short time by heating a sheet printed by the printing unit 4. The drying unit 8 has a conveyance belt and conveyance rollers for feeding a sheet to the next process.

The sheet take-up unit 9 temporarily takes up, when two-sided printing is performed, a continuous sheet having a surface the printing of which is finished. The sheet take-up unit 9 has a rotating take-up drum for taking up a sheet. An uncut continuous sheet having a surface the printing of which has been completed is temporarily taken up by the take-up drum. Upon completion of take-up of a sheet, the take-up drum is reversely rotated, so that the taken-up sheet is supplied to the decurling unit 2 and fed to the printing unit 4. This sheet is reversed front to back. Thus, the printing unit 4 can print the back surface of this sheet. A more specific two-sided printing operation will be described below.

The discharging/conveying unit 10 conveys a sheet which is cut by the cutter unit 6 and dried by the drying unit 8, and transfers the sheet to the sorter unit 11. The sorter unit 11 discharges printed sheets by sorting, if necessary, the printed sheets by groups into different types of the discharging trays 12.

Figure 7:
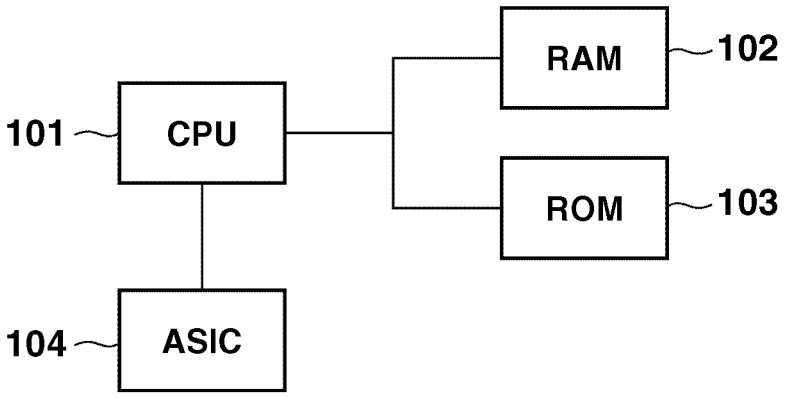
FIG. 7 illustrates a configuration of a controller according to the exemplary embodiment of the present invention.

The control unit 13 has a power supply and a drive circuit and controls the printer. FIG. 7 illustrates a configuration of a controller included in the control unit. For simplicity of drawing, in FIG. 7, drawing of a motor driver, a sensor, and the like is omitted. The controller 15 includes a central processing unit (CPU) 101, memories (e.g., a random access memory (RAM) 102 and a read-only memory (ROM) 103), and an application specific integrated circuit (ASIC) 104. The CPU 101 controls jobs which will be described below. The ASIC 104 controls a recording head (print head), sheet conveyance, a motor and image data, and performs communication processing with an external device. An operation of the printer is controlled based on signals and information from an information apparatus 16 such as a host computer.

Next, basic printing operations are described below. An operation of performing one-sided printing and that of performing two-sided printing (duplex printing), which differ from each other, are respectively described hereinafter.

Figure 2:
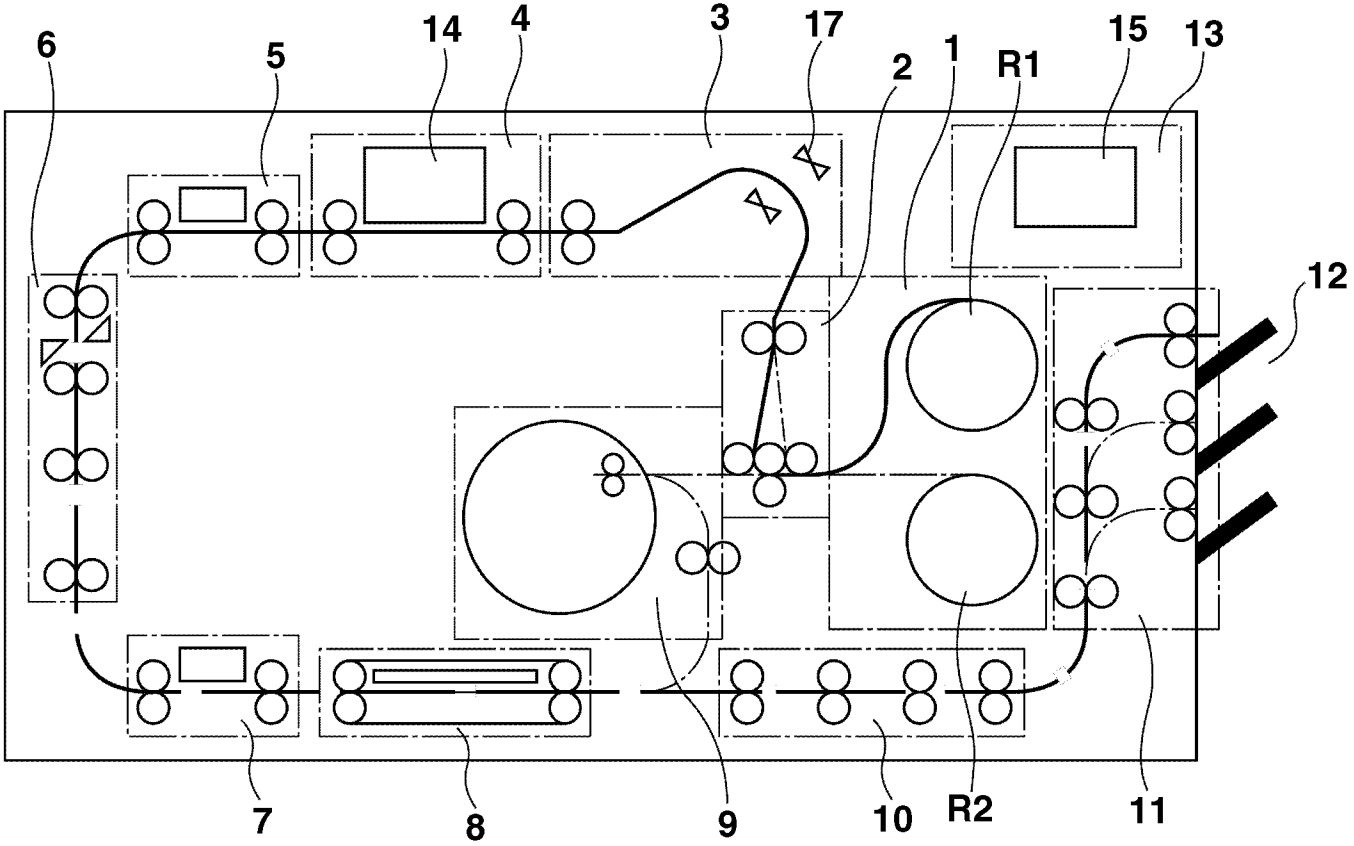
FIG. 2 illustrates a printing operation according to the exemplary embodiment of the present invention.

FIG. 2 illustrates an operation in the case of performing one-sided printing. A conveyance path in which a sheet supplied from the sheet supply unit 1 is printed and discharged to the discharging trays 12 is indicated by a thick line. A sheet supplied from the sheet supply unit 1 and processed in the decurling unit 2 and the skew correcting unit 3 is subjected to front-side printing in the printing unit 4. Then, the printed sheet passes through the inspecting unit 5 and is cut into cut-sheets, each of which has a preset and predetermined unit length, in the cutter unit 6. If necessary, print information is printed on each back side of the cut-sheets in the information recording unit 7. Then, the cut-sheets are conveyed to the drying unit 8 one by one and dried therein. Subsequently, the cut-sheets are sequentially discharged to the trays 12 of the sorter unit 11 via the discharging/conveying unit 10 and stacked therein.

Figure 3:
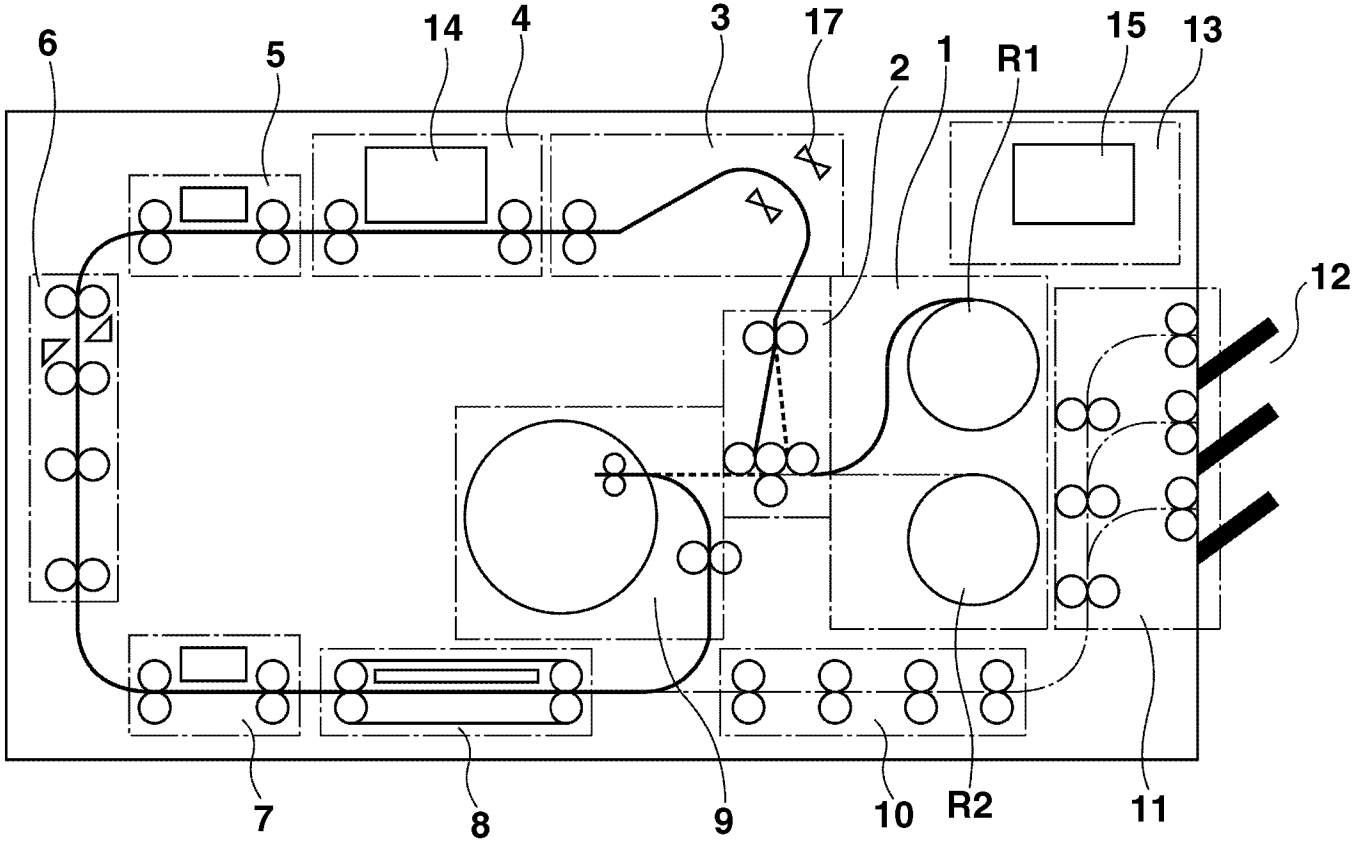
FIG. 3 illustrates another printing operation according to the exemplary embodiment of the present invention.

FIG. 3 illustrates an operation in the case of performing two-sided printing. When two-sided printing is performed, a back-side printing sequence is executed subsequent to a front-side printing sequence. First, in the front-side printing sequence, an operation performed in each of the units from the sheet supply unit 1 to the inspecting unit 5 is the same as that performed in the same unit in the above one-sided printing. In the cutter unit 6, an operation of cutting a continuous sheet is not performed. The continuous sheet is conveyed to the drying unit 8 as it is. After ink on the front surface of the continuous sheet is dried in the drying unit 8, the sheet is introduced to a path at the side of the sheet take-up unit 9, instead of a path at the side of the discharging/conveying unit 10. The introduced continuous-sheet is taken up to the take-up drum (rotating body) of the sheet take-up unit (sheet reverse unit) 9 rotating in a forward direction (counterclockwise direction, as viewed in FIG. 3). Upon completion of performing scheduled front-side printing at the recording unit 4, the continuous sheet is cut at a back end of a printed region thereof at the cutter unit 6. The continuous sheet at a downstream side (printed side) in the conveyance direction with respect to the cut position (cut back-end) passes through the drying unit 8 and is completely taken up to the back end (cut position) of the sheet by the sheet take-up unit 9. On the other hand, the continuous sheet at an upstream side in the conveyance direction with respect to the cut position is wound back to the sheet supply unit 1 so that a front end of the sheet is not left in the decurling unit 2.

Subsequently to the above front-side printing sequence, a sequence to be currently executed is changed to the back-side printing sequence. The take-up drum of the sheet take-up unit 9 rotates in a direction (clockwise direction, as viewed in FIG. 3) opposite to a direction in which the take-up drum rotates when the continuous sheet is taken up to the sheet take-up unit 9. An end portion (the back end of the sheet in the case of taking-up serves as a front end of the sheet in the case of feeding the sheet) of the taken-up sheet is fed into the decurling unit 2. In the decurling unit 2, curl correction is performed in a direction opposite to a direction of decurling in the above front-printing sequence. This is because the sheet taken up by the take-up drum is wound by reversing the sheet of the roll in the sheet supply 1 front to back so as to be curled in a direction opposite to the direction of curling the sheet of the roll. Then, the sheet subjected to the curl correction passes through the skew correcting unit 3 and enters the printing unit 4, in which the back surface of the continuous sheet is printed. The printed sheet passes through the inspecting unit 5 and is cut in the cutter unit 6 into cut-sheets of the preset and predetermined unit length. Each cut-sheet is such that both the front and back surfaces thereof are printed. Accordingly, print information is not printed on each cut-sheet in the information recording unit 7. The cut-sheets are conveyed to the dying unit 8 one by one. Then, the cut-sheets are sequentially discharged to and stacked on the tray 12 of the sorter unit 11 via the discharging/conveying unit 10.

Next, a first exemplary embodiment of the printer of the above configuration according to the present invention is described hereinafter. In the following description of the first exemplary embodiment, a one-sided printing operation is described. A detection sensor 17 for detecting an unsuitable part (unsuitable region) illustrated in FIG. 1 is of the contact or noncontact type. The detection sensor 17 detects the front side of a sheet prior to perform front-side printing. The detection sensor 17 is installed between the sheet supply unit 1 and the printing unit 4. The unsuitable part (the unsuitable region) includes a connecting tape, a skip indication marker, a smudge, a flaw, a crease. The quality of an image printed on the unsuitable part is lower than that printed on another part. The detection sensor 17 detects whether a connecting tape, a skip indication marker, a smudge, a flaw, a crease or the like exists on a sheet. The skip indication marker is assumed to be able to indicate a size of the unprintable region by a color, a position, and a width of the marker, and information such as symbols and characters described thereon. The type of the sensor and the number of the installed sensors are not limited to the above-described ones.

FIG. 4A illustrates an example of a job management table. The job management table includes jobs configuring a printing operation. For example, a preliminary discharge job, an image job, a cut mark job, a blank-margin job, an adjustment pattern job, and an idle job are available as the jobs. In addition, mode numbers and storage destination addresses are set. The CPU 101 configures a sequence of printing-operations by combining the jobs with one another and sequentially executing the combined jobs. The cut mark job is to print a cut mark. The adjustment pattern job is to print an adjustment pattern.

FIG. 4B illustrates an example of a print job table. The print job table is generated by registering jobs in an order of execution thereof in a printing operation, based on the job management table. In the print job table, a queue number and a mode number of each job and the number of print lines (raster lines) in each job are set. The CPU 101 executes the jobs registered in this table.

FIG. 4C illustrates an example of an unprintable part skip table (hereinafter referred to simply as a skip table). The skip table is generated by entering, in an order of execution, jobs for skipping printing to be performed on an unprintable part based on the job management table. In the skip table, a queue number representing a position in the print job table, into which jobs are inserted, and mode numbers of such jobs and the number of print lines corresponding to each of such jobs are set. A size of each necessary blank-margin changes due to a cause of an unprintable part. A blank-margin job for an unprintable part is determined according to each cause of the unprintable part. Thus, a useless blank-margin of the sheet is suppressed from being generated. For example, three types of blank-margins 4 are determined from a blank-margin 2. In addition, the different numbers of lines are determined respectively corresponding thereto.

Figure 5:
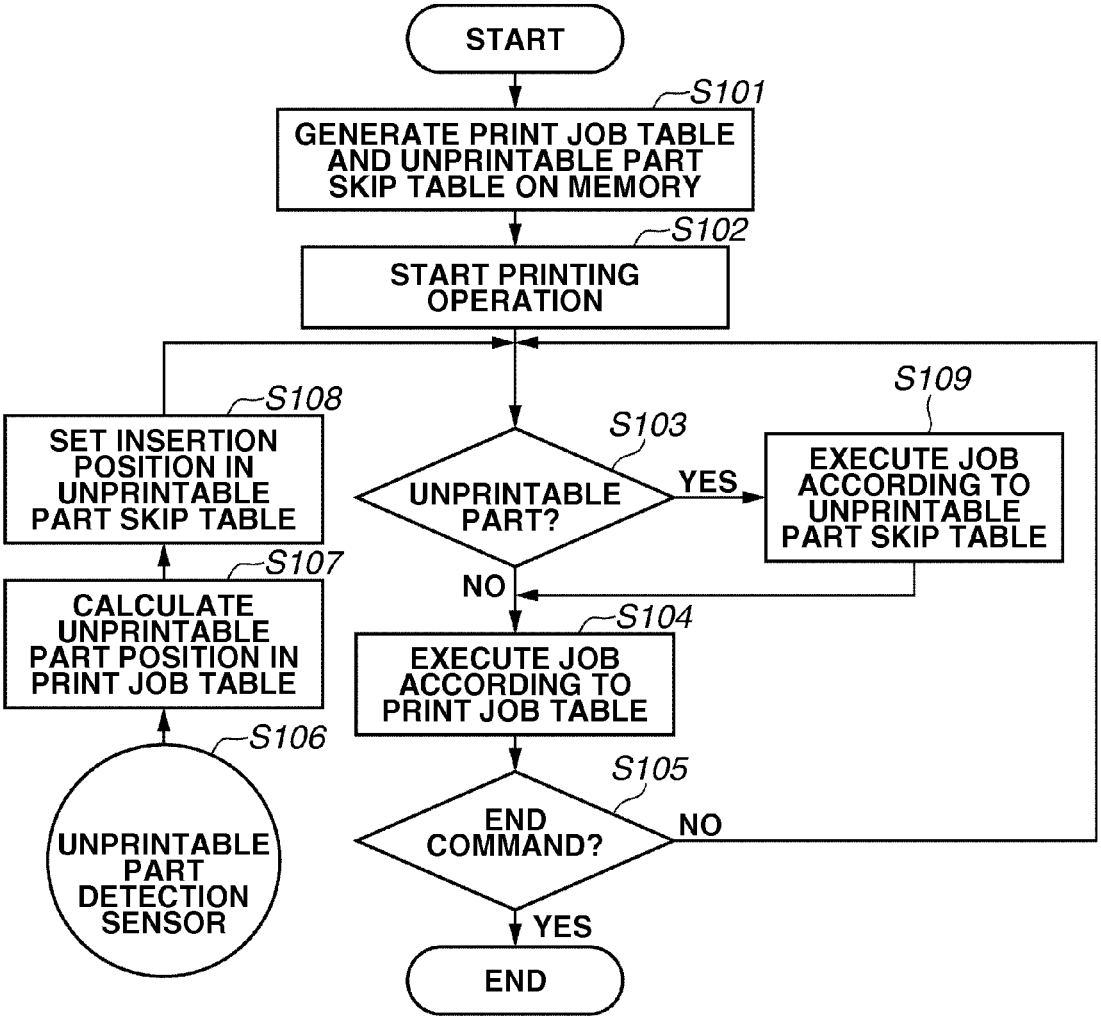
FIG. 5 is a flowchart illustrating a control sequence according to the exemplary embodiment of the present invention.

FIG. 5 illustrates a control sequence (process) using the job table. In step S101, the CPU 101 generates a print job table and a skip table on a memory (e.g., a synchronous dynamic random access memory (SDRAM)) by entering each job based on the job management table before starting printing. The SDRAM is provided as the RAM 102 illustrated in FIG. 7. The skip table can be generated after detecting an unprintable part. Upon completion of generating each of the tables, the process proceeds to step S102, in which the CPU 101 starts a printing operation. In step S103, the CPU 101 determines whether an area on which an image is printed according to a job to be executed is not an unprintable part (unprintable region). If the area is not an unprintable part (NO in step SS103), the process proceeds to step S104, in which the CPU 101 executes one of jobs in the print job table. After the execution of the job is finished, the process proceeds to step S105, in which the CPU 101 determines whether the next job in the print job table is an end command. If the next job is the end command (YES instep S105), the CPU 101 ends a printing operation. If the next job is not the end command (NO in step S105), the process returns to step S103.

On the other hand, if the unprintable detection sensor 17 detects an unprintable part (unprintable region) in step S106, then in step S107, the CPU 101 checks (specifies) a job in which the detected unprintable part (unprintable region) is printed. In this processing, a job corresponding to the unprintable part is determined by calculating, e.g., a length (distance) of a sheet conveyance path to the print head 14 from a position of the detection sensor 17 or a position at which the unprintable part is detected, and counting the number of lines from a currently executed job included in the print job table. In other words, the number of lines from the detected region to a position at which recording is performed by the recording head is acquired. Then, a job to be inserted is determined (specified) from the acquired number of lines. The CPU 101 also acquires an address of the table in which this job is registered.

In step S108, the CPU 101 sets a queue number indicating a position in the skip table, at which the job is inserted. For example, if it is calculated that a region to be printed in an image print job, whose queue number is 7, in the print job table illustrated in FIG. 4B includes an unprintable part, the CPU 101 sets 7 as the queue number at a position, at which the job is inserted, in the skip table illustrated in FIG. 4C. In addition, the CPU 101 sets a mode number of a blank-margin corresponding to a cause of the detected unprintable part and the associated number of lines by selecting, from the job management table, the mode number and the number of lines to be set.

If the CPU 101 determines that a job is set in the skip table (YES in step S103), the process proceeds to step S109, in which when starting the execution of the job whose queue number is 7, the CPU 101 executes a job corresponding to "blank-margin 2" while referring to the skip table instead of the print job table. Then, the CPU 101 executes jobs registered in the skip table sequentially. If, in step S109, the jobs registered in the skip table are completed, the process proceeds to step S104, in which the CPU 101 returns to the reference to the print job table. Then, the CPU 101 returns to the execution of the job registered in the print job table. The CPU 101 then executes the job, whose queue number is 7, to perform the rest of the printing operation.

Figure 6:
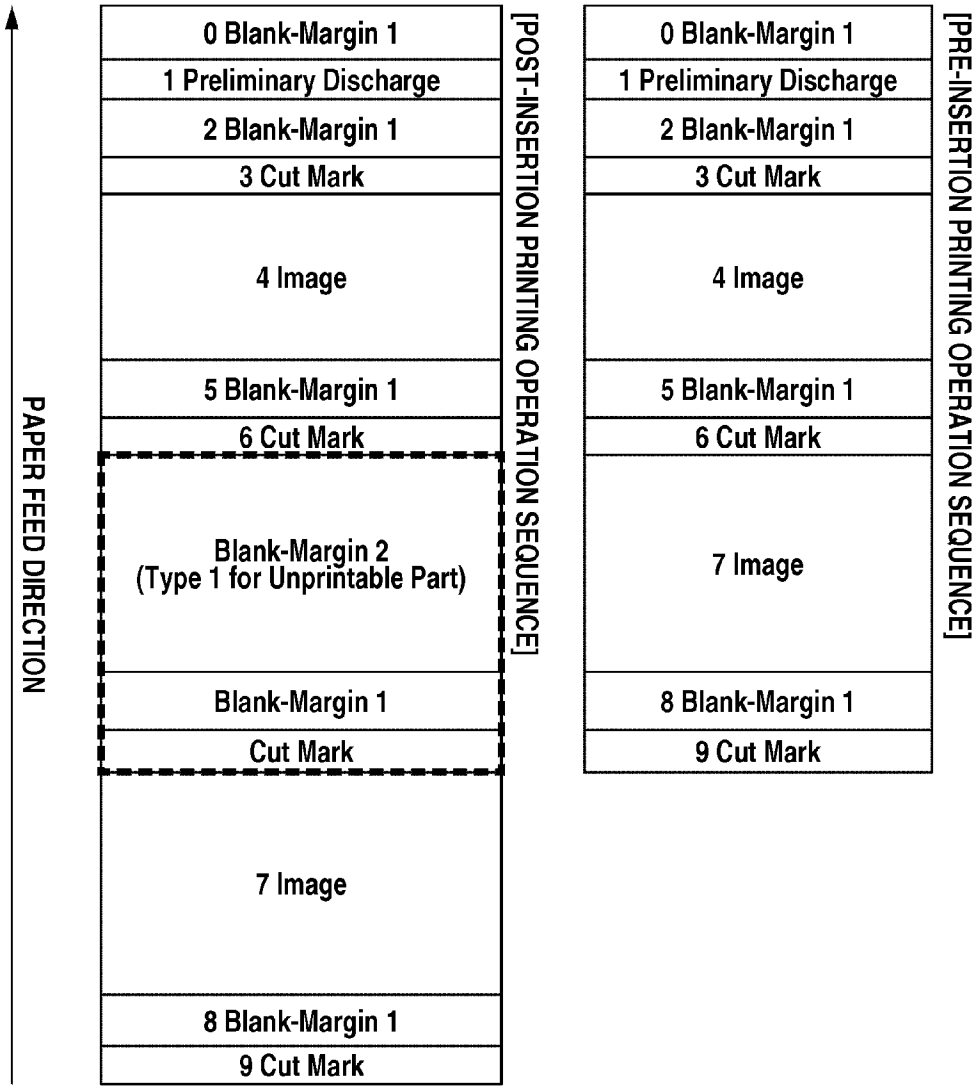
FIG. 6 conceptually illustrates a printing process according to the exemplary embodiment of the present invention.

FIG. 6 illustrates a flow of the printing operation into which jobs registered in the skip table are inserted (i.e., the printing operation interrupted by the jobs registered in the skip table). If no unprintable part is detected, an image corresponding to an image job, whose queue number is 7, is printed subsequent to execution of a cut mark job whose queue number is 6, as illustrated in an upper part of FIG. 6. On the other hand, if the CPU 101 determines that a print region to be printed by executing the job whose queue number is 7 includes an unprintable part, jobs registered in the skip table are inserted, as illustrated by a lower part of FIG. 6. Consequently, a "blank-margin 2" job and a "blank-margin 1" job, and a cut mark job are executed subsequent to the execution of a cut mark job whose queue number is 6. Then, an image job, whose queue number is 7, to print an image is executed.

According to the first exemplary embodiment, an unprintable part is detected during a normal printing operation. Even when an operation of skipping printing to be performed on an unprintable part is included in the printing operation, printing can be performed while a paper feed speed is maintained in a time period from a print start to a print end.

The first exemplary embodiment is an example of skipping, in one-sided printing, an operation of skipping printing to be performed on an unprintable part. A second exemplary embodiment is an example of performing back-side printing during two-sided printing (duplex printing). Hereinafter, differences between the first exemplary embodiment and the second exemplary embodiment are described while omitting descriptions of similarity therebetween.

In case that the detection sensor 17 detects an unsuitable part on the front side of a sheet, the printer performs an operation of skipping printing based on a result of the detection in front-side printing. Upon completion of front-side printing, the take-up drum of the sheet take-up unit 9 rotates in a direction opposite to a direction of rotation of the drum during a sheet is taken up by the sheet take-up unit 9. Thus, an end portion (i.e., a back end of the sheet serves as a front end of the sheet) of the taken-up sheet is fed into the decurling unit 2. Then, back-side printing is performed by executing jobs registered in the print job table illustrated in FIG. 4B, which are executed in the front-side printing, in an order opposite to an order of execution in the front-side printing. Consequently, the position of printing corresponding to each job on the front surface of the sheet coincides with that of printing corresponding thereto on the back surface of the sheet. That is, the printing corresponding to each of jobs, such as an image job, a cut mark job, a blank-margin job, and a preliminary discharge job, is performed at the same position on each of the two sides, i.e., the front surface and the back surface of the sheet. Accordingly, an operation of skipping printing to be performed on each unprintable part is inserted at a position in the back-side printing, which corresponds to an insertion position set in the front-side printing, at which a job whose queue number corresponds to a job to be inserted is inserted. Consequently, an operation of skipping printing to be performed on an unprintable part is performed at the same position on each of the front surface and the back surface. Thus, even when back-side printing is performed, printing to be performed on an unprintable part is skipped.

When one-side of a sheet is printed in a two-sided printing mode, no cut mark is printed. In addition, a blank-margin job corresponding to the number of lines equal to that of lines corresponding to a cut mark is performed. Consequently, a position corresponding to each job on the front surface can be adjusted to that corresponding to an associated job on the back surface.

According to the second exemplary embodiment, the back-side printing, whose contents are synchronized with those of the front-side printing when the back-side printing is performed, can be implemented using a system according to the first exemplary embodiment. In a time period from a print start to a print end of back-side printing including an operation of skipping printing to be performed on an unprintable part, similarly to that of skipping printing, printing can be performed while a paper feed speed is maintained substantially at a constant value.

A third exemplary embodiment is an example of performing front-side printing during two-sided printing (duplex printing). Hereinafter, differences between the second exemplary embodiment and the third exemplary embodiment (and differences between the first exemplary embodiment and the third exemplary embodiment) are described while omitting descriptions of similarity therebetween. The detection sensor 17 detects the front side and the back side of a sheet prior to performing front-side printing. In case that the detection sensor 17 detects an unsuitable part on the back side of the sheet, the printer performs an operation of skipping printing based on a result of the detection in front-side printing.

In the foregoing description, the exemplary embodiments have been described. The recording medium to be printed is not limited to a continuous sheet wound like a roll. An A4 cut-sheet and a letter-size cut-sheet can be used as the recording medium according to the present embodiment.

According to the second exemplary embodiment, when one side of a sheet is printed in a two-sided printing mode, a cut mark can be printed. However, the printing can be controlled so that when the detection sensor 17 detects a cut mark, cutting by the cutter unit 6 is omitted.

According to the second exemplary embodiment, after completion of front-side printing, in case that the detection sensor 17 detects an unsuitable part on the back side of a sheet, the CPU 101 changes a print job table. For example, the CPU 101 sets, in the print job table, an image job that has been executed in the previous front-side printing.

A printing operation can be ended by registering an idle job in the print job table illustrated in FIG. 4B, instead of an end command.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An apparatus comprising:

a determining unit configured to determine an unsuitable area that is not suitable for printing of a print medium; and a print control unit configured to cause a print unit to print an image on the print medium and to cause the print unit to skip printing of the image so as not to print the image on the unsuitable area in accordance with the unsuitable area determined by the determining unit, wherein the print control unit varies an amount for causing the print unit to skip the printing of the image, according to the unsuitable area, and wherein the print control unit causes the print unit to skip the printing of the image by inserting a blank-margin job into a queue of a print job table.

2. The apparatus according to claim 1, wherein the determining unit determines a length in a direction of conveyance of the print medium as a length of the unsuitable area.

3. The apparatus according to claim 1, wherein the determining unit determines the unsuitable area by obtaining a sensing result of a sensor equipped on an upper stream of the print unit in a direction of conveyance of the print medium.

4. The apparatus according to claim 1, wherein the print control unit causes the print unit to print a cut mark for causing a cutter to cut the print medium after the skipping of the printing is performed.

5. The apparatus according to claim 1, wherein the determining unit determines an image to be printed corresponding to the unsuitable area, and the print control unit causes the print unit to print the image determined by the determining unit on a subsequent area to the unsuitable area without printing on the unsuitable area.

6. The apparatus according to claim 1, wherein the print medium is a continuous sheet.

7. The apparatus according to claim 1, further comprising:

a generation unit configured to generate a print job table indicating an order of execution of printing operations including printing of an image; and a setting unit configured to set information for specifying an order of execution of a skip table for skipping the printing on the unsuitable area, wherein the print control unit causes the print unit to skip the printing on the unsuitable area based on the skip table and causes the print unit to continue a printing operation on a subsequent area to the unsuitable area based on the print job table generated by the generation unit.

8. The apparatus according to claim 7, further comprising a second generation unit configured to generate the skip table, wherein the skip table indicates an order of execution of printing operations for skipping the printing to be performed on the unsuitable area.

9. A method comprising:

determining an unsuitable area that is not suitable for printing of a print medium; and printing an image on the print medium and skipping the printing of the image so as not to print the image on the unsuitable area in accordance with the determined unsuitable area, wherein an amount for causing the print unit to skip the printing of the image is varied, according to the unsuitable area, and wherein the skipping is performed by inserting a blank-margin job into a queue of a print job table.

10. The method according to claim 9, wherein the determined unsuitable area corresponds to a length in a direction of conveyance of the print medium.

11. The method according to claim 9, wherein the determined unsuitable area is determined by obtaining a sensing result of a sensor equipped on an upper stream of the print unit in a direction of conveyance of the print medium.

12. The method according to claim 9, further comprising printing a cut mark for causing a cutter to cut the print medium after the skipping of the printing is performed.

13. The method according to claim 9, further comprising:

generating a print job table indicating an order of execution of printing operations including printing of an image; and setting information for specifying an order of execution of a skip table for skipping the printing on the unsuitable area, wherein the printing is performed so that the printing on the determined unsuitable area is skipped based on the skip table, and a printing operation is continued on a subsequent area to the unsuitable area based on the generated print job table.

14. An apparatus comprising:

a determining unit configured to determine an unsuitable area that is not suitable for printing of a print medium;

a generation unit configured to generate a print job table indicating an order of execution of printing operations including printing of an image;

a setting unit configured to set information for specifying an order of execution of a skip table for skipping the printing on the unsuitable area; and a print control unit configured to cause a print unit to print an image on the print medium based on the print job table generated by the generation unit, wherein the print control unit causes the print unit to skip printing on the unsuitable area determined by the determination unit based on the skip table, and causes the print unit to continue a printing operation on a subsequent area to the unsuitable area based on the print job table generated by the generation unit.

15. The apparatus according to claim 14, wherein the print control unit causes the print unit to perform a duplex printing, the determining unit determines the unsuitable area on a first surface of the print medium, and the print control unit causes the print unit to skip the printing both on the first surface and a second surface, that is a back of the first surface, of the print medium, in accordance with the unsuitable area on the first surface determined by the determining unit.

16. The apparatus according to claim 14, wherein the print control unit causes the print unit to skip the printing of the image by inserting a blank-margin job into a queue of a print job table.

17. The apparatus according to claim 14, wherein the print control unit causes the print unit to print a cut mark for causing a cutter to cut the print medium after the skipping of the printing is performed.

* * * * *